United States Patent [19]

Aramaki

[11] Patent Number: 4,796,850

[45] Date of Patent: Jan. 10, 1989

[54] COOKING APPARATUS FOR MOUNTING ON A WALL

[75] Inventor: Yoshihiro Aramaki, Yamatokoriyama, Japan

[73] Assignee: Sharp Kabushiki Kaisha, Osaka, Japan

[21] Appl. No.: 186,766

[22] Filed: Apr. 22, 1988

Related U.S. Application Data

[63] Continuation of Ser. No. 37,061, Apr. 13, 1987, abandoned, which is a continuation of Ser. No. 826,756, Feb. 6, 1986, abandoned.

[30] Foreign Application Priority Data

Mar. 14, 1985 [JP] Japan ..... 60-37831[U]

[51] Int. Cl.[4] ..... F16M 1/00

[52] U.S. Cl. ..... 248/674; 248/309.1

[58] Field of Search ..... 248/309.1, 313, 311.2, 248/310, 674; 312/245, 246, 242, 248; 211/90, 87, 88

[56] References Cited

U.S. PATENT DOCUMENTS

| | | | |
|---|---|---|---|
| 462,123 | 10/1891 | Friede | 211/88 X |
| 1,270,718 | 6/1918 | Ford | 211/90 X |
| 1,846,129 | 2/1932 | Gibbs | 211/90 X |
| 2,491,652 | 12/1949 | Feerick | 211/90 X |
| 3,116,497 | 1/1964 | Dedinski | 312/245 X |
| 3,129,819 | 4/1964 | Chandler | 211/90 X |
| 3,491,977 | 1/1970 | Iller | 312/245 X |
| 4,313,043 | 1/1982 | White | 312/245 X |
| 4,453,690 | 6/1984 | Takeuji | 248/309.1 |
| 4,465,256 | 8/1984 | Wolbrink | 312/245 X |
| 4,580,853 | 4/1986 | Hitzeroth | 312/245 |

FOREIGN PATENT DOCUMENTS

| | | | |
|---|---|---|---|
| 2155768 | 10/1985 | United Kingdom | 312/245 |

*Primary Examiner*—J. Franklin Foss

*Attorney, Agent, or Firm*—Flehr, Hohbach, Test, Albritton & Herbert

[57] ABSTRACT

A cooking apparatus such as a combined microwave oven and a range hood for mounting on a wall surface according to this invention has a unitized mounting structure removably attachable to its housing. The mounting structure having back and bottom plates which form portions of the housing are first attached to the wall surface and the housing is subsequently secured to this structure to become mounted on the wall. The cooking apparatus can thus be mounted easily even by one person.

2 Claims, 2 Drawing Sheets

COOKING APPARATUS FOR MOUNTING ON A WALL

This is a continuation of application Ser. No. 037,061 filed Apr. 13, 1987, now abandoned which is a continuation of application Ser. No. 826,756 filed Feb. 6, 1986 abandoned.

This invention relates to a cooking apparatus such as a combined microwave oven and a range hood adapted to be mounted on a wall and in particular to a structure for mounting such a cooking apparatus on a wall.

In FIG. 4 which is a side cross-sectional view showing how a cooking apparatus may be mounted in a kitchen wall by a conventional method such as disclosed in U.S. Pat. No. 4,453,690 assigned to the present assignee, numeral 1 indicates a cooking apparatus such as a combined microwave oven and a range hood of a so-called space-saver type and numeral 2 indicates an attachment board which is a part of the mounting assembly for mounting the apparatus 1 on a wall surface below a shelf 3 and above a gas range 4. The board 2 has a protruding section at its bottom and is preliminarily secured to a wall surface by screws or the like. The apparatus 1 is subsequently secured to this attachment board 2 by engaging the bottom rear edge of the apparatus 1 to this protruding part at the bottom edge of the attachment board 2. As shown in FIG. 5, a coupling member 5 is placed inside the cooking apparatus 1 near its back wall 15 which is provided with an elongated aperture 6 such that an engaging portion 7 horizontally protruding from the attachment board 2 will be projected through the aperture 6 when the cooking apparatus 1 is secured to the attachment board 2 in the manner described above and illustrated in FIG. 4. The top end of the coupling member 5 is connected rotatably through a pivot 18 to a relatively shorter rod 16 which is secured rotatably around a fulcrum 17 to the back wall 15 of the cooking apparatus 1. When the coupling member 5 is pushed up, the corresponding force is communicated to the rod 16 through the pivot 18 and the rod 16 is caused to rotate in a clockwise direction as shown by the arrows until the opposite end of the rod 16 latches to the engaging portion 7 as shown by the broken lines in FIG. 5. The cooking apparatus 1 is thus fastened to the attachment board 2 behind it and is prevented from falling to the front.

The method of mounting a cooking apparatus on a wall as described above is inconvenient because not only is the cooking apparatus relatively heavy but also the coupling member must be operated while the cooking apparatus itself is pressed against the attachment board over an existing gas range or the like and it frequently takes two persons to mount such an apparatus on the wall.

It is therefore an object of the present invention in view of the above to provide a cooking apparatus such as a combined microwave oven and a range hood which can be installed easily on a wall without increasing the number of component parts.

The above and other objects of the present invention are achieved by providing a cooking apparatus of the space-saver type having a unitized mounting structure comprising portions of the back and bottom plates forming parts of its housing such that this mounting structure is initially secured to the wall surface and the housing is subsequently attached to this mounting structure.

The accompanying drawings, which are incorporated in and form a part of the specification, illustrate an embodiment of the present invention and, together with the description, serve to explain the principles of the invention.

Figure 1:
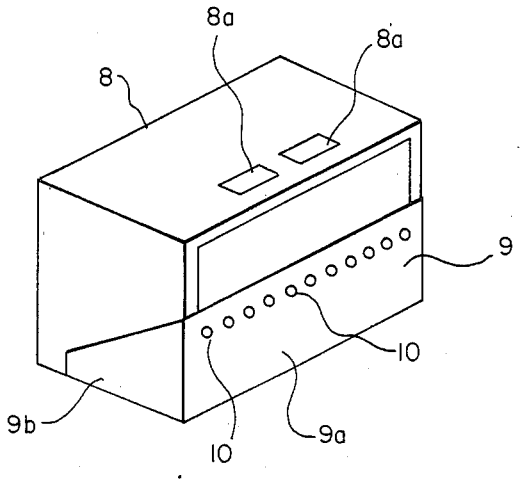
FIG. 1 is a perspective view of the backside of a cooking apparatus embodying the present invention.
Figure 2:
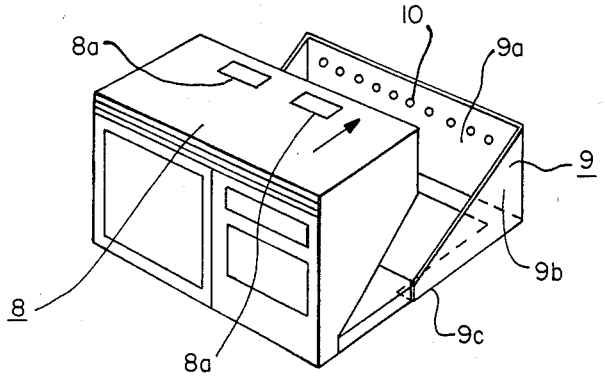
FIG. 2 is a partially fragmented perspective view of the cooking apparatus of FIG. 1.
Figure 3:
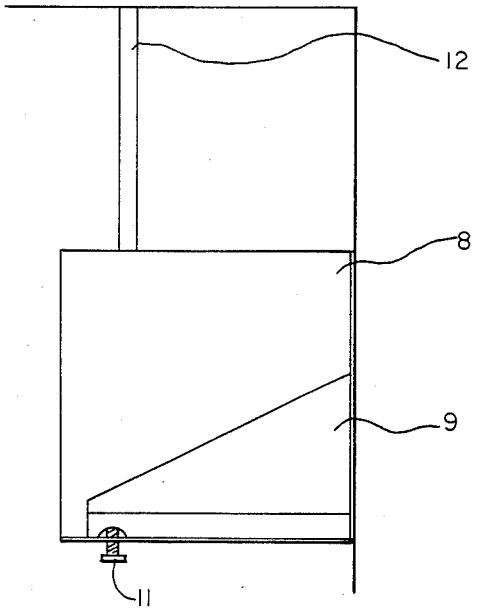
FIG. 3 is a side view of the cooking apparatus of FIGS. 1 and 2 when it has been mounted on a wall.
Figure 4:
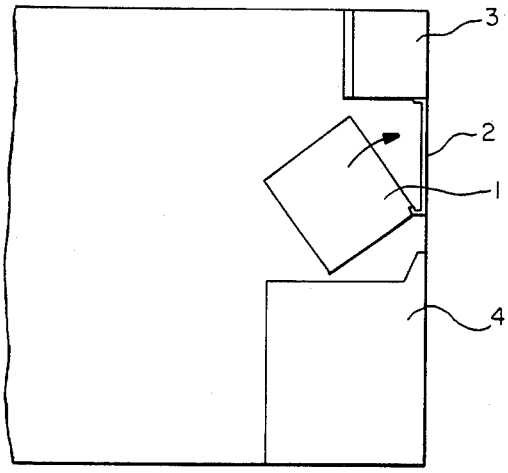
PRIOR ART FIG. —4
FIG. 4 is a side view of a conventional cooking apparatus in the process of being mounted on a kitchen wall.
Figure 5:
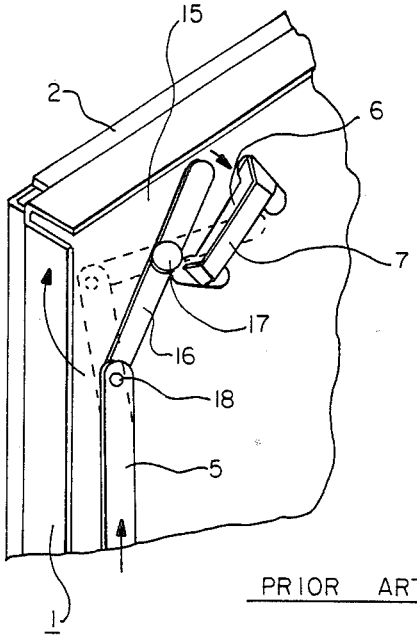
PRIOR ART FIG.—5
FIG. 5 is an enlarged perspective view of a section inside the conventional cooking apparatus of FIG. 4.

Reference being made to FIGS. 1, 2 and 3 which illustrate a cooking apparatus such as a combined microwave oven and a range hood of the space-saver type embodying the present invention, numeral 8 generally indicates a housing for the apparatus provided with exhaust outlets **8*a* on the top surface and inlets (not shown) on the bottom surface. A fan and other components for discharging the exhaust gas, smoke and the like may be enclosed within the housing 8**.

Reference being still made to FIGS. 1, 2 and 3, numeral 9 indicates a mounting structure which is adapted to be secured to the housing 8 by screws or the like and to become a part of the housing 8 as best shown in FIG. 1. The mounting structure 9 comprises a back plate **9*a* which is adapted to be attached to a wall, side plates 9*b* which serve as guides for the side surfaces of the housing 8 slidingly joined with the mounting structure 9, and a bottom plate 9*c* for supporting the housing 8 from below. The back plate 9*a* is provided with apertures for screws for securing the mounting structure 9** to a wall surface.

When the cooking apparatus of FIGS. 1, 2 and 3 is mounted on a wall, the mounting structure 9 is initially secured on a wall surface by means of screws or the like. Next, the housing 8 of the apparatus is slidingly positioned on the mounting structure 9 and screws 11 are used in this position to secure the housing 8 by pushing it upwards and pressing its top surface against the shelf 12 as shown in FIG. 3.

In summary, portions of the back and bottom walls of the apparatus are made into a separate but unitized removable structure attached to the housing of the apparatus such that the cooking apparatus can be mounted on a wall surface by first securing this mounting structure to the wall and then fastening the housing to this mounting structure. Thus, the cooking apparatus can be installed easily by one person and the number of component parts is reduced according to this invention because portions of the outer walls of the apparatus are utilized as the structure for the purpose of mounting the cooking apparatus.

The foregoing description of a preferred embodiment of the invention has been presented for purposes of illustration and description. It is not intended to be exhaustive or to limit the invention to the precise form disclosed, and obviously many modifications and variations are possible in light of the above teaching. Such changes and modifications which may be apparent to a person skilled in the art are intended to be within the scope of this invention.

What is claimed is:

1. A cooking apparatus for mounting on a wall comprising a front structure and a back structure which are removably attachable to each other to form together a housing for said apparatus, said back structure including back and bottom plates which form portions of said housing, said back structure being directly attached to a wall surface, said apparatus becoming mounted on said wall surface with said front structure becoming secured to said back structure; and wherein said back structure further includes side plates, said front structure also includes side plates, and said side plates of said front and back structures fit together to form side walls of said housing; and wherein said housing is slidably attachable to said back structure.

2. The apparatus of claim 1 wherein said back plate is provided with apertures.

* * * * *